US011638512B2

(12) United States Patent
Sun et al.

(10) Patent No.: US 11,638,512 B2
(45) Date of Patent: May 2, 2023

(54) ROBOT CLEANER

(71) Applicant: LG ELECTRONICS INC., Seoul (KR)

(72) Inventors: Changhwa Sun, Seoul (KR); Jungmin Ko, Seoul (KR); Jihyun Lim, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 143 days.

(21) Appl. No.: 16/939,595

(22) Filed: Jul. 27, 2020

(65) Prior Publication Data

US 2021/0330160 A1 Oct. 28, 2021

(30) Foreign Application Priority Data

Apr. 24, 2020 (KR) ..... 10-2020-0050063

(51) Int. Cl.
*A47L 11/30* (2006.01)
*A47L 11/40* (2006.01)
*A47L 9/16* (2006.01)

(52) U.S. Cl.
CPC ..... *A47L 11/302* (2013.01); *A47L 9/1683* (2013.01); *A47L 11/4083* (2013.01); *A47L 11/4088* (2013.01); *A47L 2201/00* (2013.01)

(58) Field of Classification Search
CPC ..... A47L 11/4088; A47L 11/201; A47L 11/4094; A47L 11/4036; A47L 11/4072;
(Continued)

(56) References Cited

U.S. PATENT DOCUMENTS 7,331,082 B2 * 2/2008 Hertrick ..... A47L 11/4091 15/320
7,620,476 B2 * 11/2009 Morse ..... A47L 11/4088 901/1

(Continued)

FOREIGN PATENT DOCUMENTS

CN 102379661 3/2012
CN 108433654 A * 8/2018 ..... A47L 11/282

(Continued)

OTHER PUBLICATIONS

Office Action in Korean Application No. 10-2020-0050063 dated May 18, 2021 (5 pages).

(Continued)

*Primary Examiner* — Bryan R Muller
*Assistant Examiner* — Jason Khalil Hawkins
(74) *Attorney, Agent, or Firm* — Birch, Stewart, Kolasch & Birch, LLP

(57) ABSTRACT

A robot cleaner is provided, including a main body forming a robot cleaner exterior, a driver coupled to the main body to move the main body, a cleaning module coupled to the main body to suck dust from a traveling surface, a dust collector removing dust from air suctioned through the cleaning module, and a wet-mop module coupled to the main body to mop the traveling surface, wherein the wet-mop module includes a wet-mop module housing surrounding at least a portion of the main body and accommodating water in an internal space, a wet-mop module wheel disposed in the wet-mop module housing, a mop disposed between the wet-mop module housing and the traveling surface, and a wet-mop pump connected to the wet-mop module wheel to supply water to the mop in response to rotation of the wet-mop module wheel. Mopping may be performed without applying physical force of a person.

12 Claims, 9 Drawing Sheets

(58) Field of Classification Search
CPC .... A47L 11/4083; A47L 11/302; A47L 9/009; A47L 2201/00; A47L 11/03; A47L 13/22; A47L 13/26; A47L 2201/06
USPC ..... 15/320, 3.14
See application file for complete search history.

(56) References Cited

U.S. PATENT DOCUMENTS

| | | | | |
|---|---|---|---|---|
| 7,870,637 | B2 * | 1/2011 | Parr | A47L 5/32 15/327.2 |
| 9,282,867 | B2 * | 3/2016 | Williams | A47L 11/4088 |
| 9,968,234 | B2 * | 5/2018 | Chao | A47L 11/305 |
| 10,905,303 | B2 * | 2/2021 | Hu | A47L 11/4072 |
| 11,109,732 | B2 * | 9/2021 | Jang | A47L 11/29 |
| 11,109,734 | B2 * | 9/2021 | Meng | A47L 9/00 |
| 2005/0015913 | A1 | 1/2005 | Kim et al. | |
| 2007/0016328 | A1 * | 1/2007 | Ziegler | G05D 1/0219 701/23 |
| 2017/0202421 | A1 * | 7/2017 | Hwang | A47L 11/4094 |
| 2022/0160203 | A1 * | 5/2022 | Xuan | A47L 11/4038 |

FOREIGN PATENT DOCUMENTS

| | | | |
|---|---|---|---|
| CN | 109363571 | A | 2/2019 |
| CN | 209360584 | U | 9/2019 |
| KR | 10-2006-0104731 | | 10/2006 |
| KR | 10-2011-0040357 | | 4/2011 |
| KR | 10-2012-0129190 | | 11/2012 |
| KR | 10-2014-0060450 | | 5/2014 |
| KR | 10-2017-0142023 | | 12/2017 |

OTHER PUBLICATIONS

Office Action in Taiwanese Application No. 1091130813 dated Apr. 8, 2021 (13 pages).
PCT International Search Report in PCT/KR2020/011364 dated Jan. 27, 2021 (9 pages).

* cited by examiner

ROBOT CLEANER

CROSS-REFERENCE TO RELATED APPLICATION

This application claims the benefit of Korean Patent Application No. 10-2020-0050063, filed on Apr. 24, 2020, which is hereby incorporated by reference as if fully set forth herein.

BACKGROUND

Field

The present disclosure relates to a robot cleaner.

Discussion of the Related Art

A person cleans a living space thereof for hygiene and cleanliness. There are many reasons for the cleaning. For example, the cleaning may be done to protect a body from disease or to prevent damage to a bronchus. Further, the cleaning may be done for a quality of life, such as, for using the space thereof in a clean state.

Dust or foreign substances settle on a floor by gravity. Thus, in order to perform the cleaning, people tend to bend their waists or sit down, so that it is easy to put a strain on the waists or joints.

To this end, in recent years, cleaners that help people clean have appeared. The cleaners may be roughly classified into a handy stick cleaner, a bar-type cleaner, a robot cleaner, and the like.

Among these, the robot cleaner cleans the space instead of a user in a specific space such as a home, an office, or the like. The robot cleaner generally performs the cleaning by suctioning dust in an area to be cleaned.

However, it may not be said that the cleaning is completed by just suctioning the dust. The reason is that there is dust that is not able to be removed only by a suction power of the robot cleaner. For example, a foreign substance attached to a floor surface or dust larger than a suction port of the robot cleaner are difficult to be removed with only the suction power of the robot cleaner.

Thus, dust visible to the naked eye is generally removed by being suctioned through a vacuum cleaner or the robot cleaner, and the cleaning is completed through mopping.

In order to effectively perform the mopping, it is desirable to contain moisture in a mop, so that invisible or small dust sticks to the mop. However, when the person is mopping, there may be pain in the waist or knees, so that a demand for a cleaner capable of automatically mopping is increasing.

Patent Document 1 and Patent Document 2 respectively disclose cleaners that remove or supply the moisture from or to the mop, but both may not be regarded as having great utility because both require a physical force of the person.

PRIOR ART DOCUMENTS

Patent Documents

Patent Document 1: US Patent Publication No. 20080010767 (published on Jan. 17, 2008)

Patent Document 2: U.S. Registered Pat. Publication No. 6,655,866 (published on Dec. 12, 2003)

SUMMARY

According to an embodiment of the present disclosure, it is intended to provide a robot cleaner capable of mopping during cleaning of the robot cleaner.

Further, it is indented to provide a robot cleaner that may smoothly guide water to a mop without a motor that supplies the water in addition to a motor that drives the robot cleaner. That is, it is intended to provide a robot cleaner that may smoothly guide water to a mop without a human power.

Further, it is indented to provide a robot cleaner that may properly adjust a water consumption by supplying water to a mop only during travel.

Further, it is indented to provide a robot cleaner that continuously supplies water such that a mop does not dry during cleaning.

As an example for solving the above-mentioned problem, a robot cleaner capable of automatically supplying water to a mop of the robot cleaner traveling by driving a pump without a motor is provided.

A robot cleaner that may travel on its own without a human power, properly adjust a water consumption by supplying water automatically only during traveling without a need for a separate motor and the like, and smoothly supply the water is provided.

Specifically, a robot cleaner that has a detachable wet-mop module mounted thereon to supply water inside the wet-mop module to the outside is provided.

One aspect of the present disclosure proposes a robot cleaner including a main body for forming an exterior of the robot cleaner, a driver coupled to the main body to move the main body, a cleaning module coupled to the main body to suck dust from a traveling surface, a dust collector for removing dust from an air suctioned through the cleaning module, and a wet-mop module coupled to the main body to mop the traveling surface, wherein the wet-mop module includes a wet-mop module housing for surrounding at least a portion of the main body and accommodating water in an internal space thereof, a wet-mop module wheel disposed in the wet-mop module housing, a mop disposed between the wet-mop module housing and the traveling surface, and a wet-mop pump connected to the wet-mop module wheel to supply water to the mop in response to a rotation of the wet-mop module wheel.

In one implementation, the robot cleaner may further include a rotation shaft connected to the wet-mop module wheel, and a pump connector eccentric to a center of the rotation shaft and connected to the wet-mop pump is provided.

In one implementation, the wet-mop pump may include a first diaphragm curved as the rotation shaft rotates, and a second diaphragm connected to the first diaphragm.

In one implementation, the wet-mop module housing may include a first module portion positioned between the main body and the traveling surface, and a second module portion formed integrally with the first module portion and covering at least a portion of an outer surface of the main body.

In one implementation, the first module portion may include a first water storage, wherein the first water storage is a space for accommodating water therein.

In one implementation, the main body may include a wet-mop module coupling portion, wherein the first module portion is able to be coupled to the wet-mop module coupling portion, and wherein the first module portion may include a main body connector to be accommodated in a space provided by the wet-mop module coupling portion.

In one implementation, the wet-mop module coupling portion may extend in a direction in which the first module portion is inserted on a surface of the main body facing the traveling surface.

In one implementation, the second module portion may include a dust-collector connector for receiving the dust collector therein.

In one implementation, the dust-collector connector may include a handle disposed to be gripped by a user, and each second water storage disposed on each of both sides of the handle to provide a space for accommodating water therein.

In one implementation, the driver may include a main wheel for moving the main body, a driver motor for providing a driving force to the main wheel, a first auxiliary wheel for assisting the movement of the main body, and a first auxiliary wheel housing disposed on the main body and coupled to the first auxiliary wheel.

In one implementation, the first module portion may include an auxiliary wheel connector opened such that the first auxiliary wheel housing is able to be connected thereto.

In one implementation, the wet-mop module housing may include a third module portion including the wet-mop module wheel.

In one implementation, the third module portion may include each recess defined therein to be connected to each wet-mop module wheel.

In one implementation, each wet-mop module wheel may be disposed on each of both sides of the first module portion, and wherein at least one of the recesses may include the wet-mop pump inserted therein.

In one implementation, a water supply passage for flowing water therethrough may be formed in the first module portion, and wherein the water supply passage may be in communication with the wet-mop pump and the mop.

According to the embodiments, the spotless cleaning may be performed through the mopping in addition to the dust removal.

Further, because a structure for supplying the water is simple, a structure of the wet-mop module may be simplified to have ease of manufacture and competitive price.

Further, because the human power is not involved, the spotless cleaning is possible without any extra effort when the user mops.

Further, it is economical because the water is not consumed excessively by supplying the water to the mop only during the travel.

BRIEF DESCRIPTION OF THE DRAWINGS

The accompanying drawings, which are included to provide a further understanding of the disclosed embodiments and are incorporated in and constitute a part of this application, illustrate embodiment(s) of the disclosure and together with the description serve to explain the principle of the disclosed embodiments. In the drawings.

DESCRIPTION OF SPECIFIC EMBODIMENTS

Figure 1:
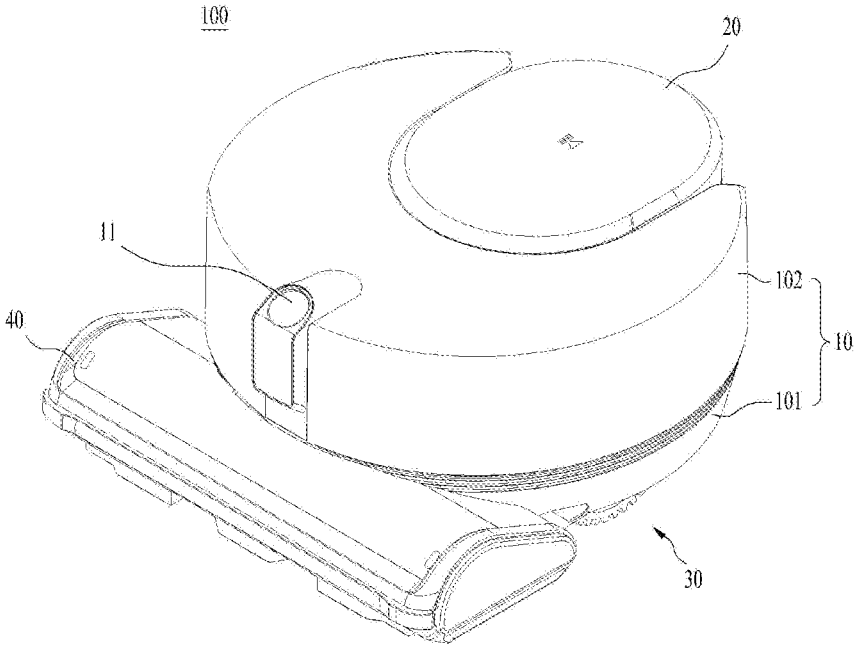
FIG. 1 is a perspective view of a robot cleaner according to an embodiment.

Hereinafter, specific embodiments of the present disclosure will be described with reference to the drawings. A following detailed description is provided to aid in a comprehensive understanding of a method, an apparatus, and/or a system described herein. However, this is only an example, and the present disclosure is not limited thereto.

In describing embodiments of the present disclosure, when it is determined that a detailed description of a known technology related to the present disclosure may unnecessarily obscure the subject matter of the present disclosure, a detailed description thereof will be omitted. In addition, terms to be described later are terms defined in consideration of functions in the present disclosure, which may vary depending on intention of a user or an operator, customs, or the like. Therefore, the definition thereof should be made based on the contents throughout the present specification. The terminology used in the detailed description is for the purpose of describing the embodiments of the present disclosure only and is not intended to be limiting of the present disclosure. As used herein, the singular forms "a" and "an" are intended to include the plural forms as well, unless the context clearly indicates otherwise. It will be further understood that the terms "comprises", "comprising", "includes", and "including" when used in the description, specify the presence of the certain features, numbers, steps, operations, elements, and portions or combinations thereof, but do not preclude the presence or addition of one or more other features, numbers, steps, operations, elements, and portions or combinations thereof.

Prior to the description, when describing embodiments in the present specification, a portion provided with a cleaning module 40 will be described as a front portion, a portion provided with a dust collector 20 will be described as a rear portion, an upper side on the drawing will be described as an upper portion, and a lower side on the drawing will be described as a lower portion.

However, this is only a standard prepared for a clear understanding of the disclosed embodiments. That is, a direction may be expressed differently based on the standard.

FIG. 1 is a perspective view of a robot cleaner according to an embodiment.

Figure 2:
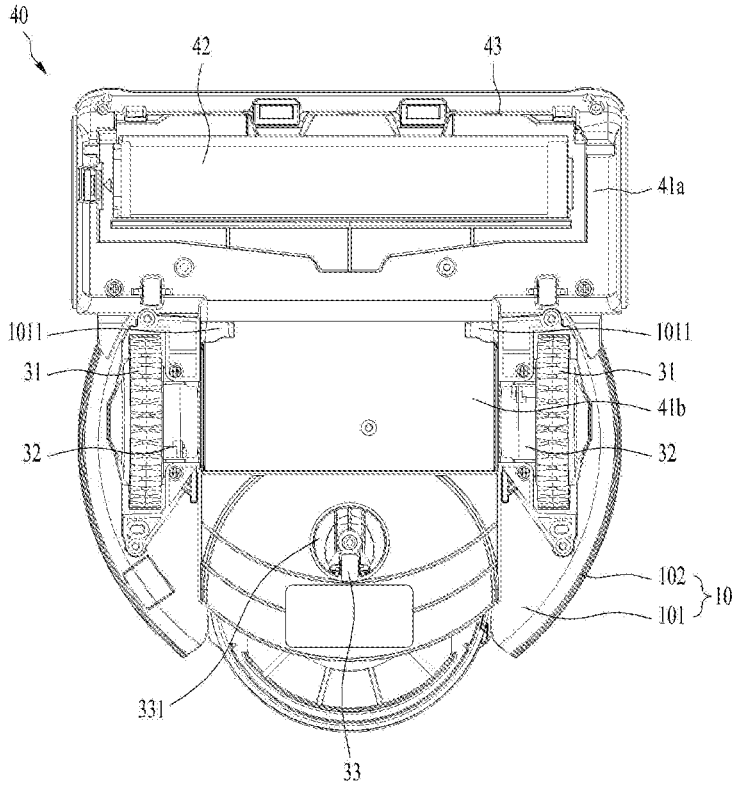
FIG. 2 is a bottom view of a robot cleaner according to an embodiment.
Figure 3:
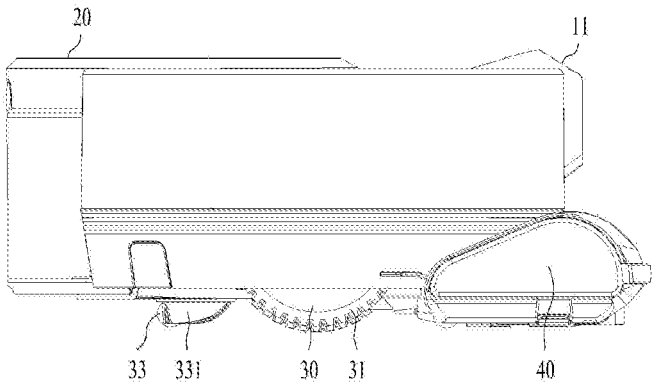
FIG. 3 is a side view of a robot cleaner according to an embodiment.

FIG. 2 is a bottom view of a robot cleaner according to an embodiment. Further, FIG. 3 is a side view of a robot cleaner according to an embodiment.

Hereinafter, a structure of a robot cleaner will be described with reference to FIGS. 1 to 3.

A robot cleaner 100 according to an embodiment may include a main body 10, a driver 30, a cleaning module housing 41, and a roller 42. Further, the robot cleaner 100 may further include a battery (not shown) for providing electric power such that the above-described driver and roller may be electrically driven.

The battery may be provided as a secondary battery and may be repeatedly charged and discharged. Thus, a user may use the robot cleaner by repeatedly charging the battery when a battery power level is low without having to replace or add a battery.

When the battery is provided as the secondary battery, the robot cleaner may further include a charging device (not shown) that may charge the robot cleaner.

In another example, the battery may be provided as a dry battery rather than the secondary battery. In this case, the dry battery may be required to be replaced when the dry battery is dead.

That is, there is no restriction on how the robot cleaner is provided with the electric power.

The main body 10 may be disposed to form an exterior of the robot cleaner 100.

The main body 10 may include a first housing 101 and a second housing 102.

The first housing 101 may form a portion of the main body 10 and may provide a space in which electronic components required for the robot cleaner 100 or parts required for the robot cleaner are mounted.

For example, a controller (not shown) that controls an operation of the robot cleaner 100 may be mounted in the first housing 101.

Further, the first housing 101 may be disposed to provide a flow path (not shown) through which air containing dust is guided to the dust collector 20 to be described later. That is, the air suctioned through the cleaning module 40 to be described later may be guided through an internal space of the first housing 101 to the dust collector 20.

The second housing 102 may be disposed in a form of a cover that covers the first housing 101. However, the second housing 102 is not limited thereto.

A display (not shown) may be disposed on one surface of the second housing 102. The display may be formed in a shape of a touch panel, so that the user may simply enter a command through the display.

It is sufficient that the second housing 102 is disposed to be coupled to the first housing 101. For example, the second housing 102 may be hinged or integrally formed with the first housing 101.

However, it is preferable that the second housing 102 is separately disposed in consideration of installation convenience of the parts mounted in the first housing 101. The second housing 102 may prevent the parts mounted in the first housing 101 from being contaminated or damaged by an outside factor.

That is, the robot cleaner according to the present embodiment may be disposed such that the parts mounted in the first housing 101 are covered by the second housing 102 and not exposed to the outside. Thus, when the parts are operating, a user's body may be injured due to user's carelessness, malfunction, or the like. Thus, the main body 10 may cover the internal parts to prevent a safety accident. Further, because the main body 10 is present, a complex interior is not exposed to the outside, thereby creating a sense of beauty. Thus, the main body 10 may be used as a design element.

The cleaning module 40 may be a portion that is coupled to the main body of the robot cleaner 100 to perform the cleaning.

The cleaning module 40 may include a cleaning module housing 41 and a roller 42.

The cleaning module 40 may be disposed to clean a traveling surface. Specifically, the cleaning module 40 may be disposed to suck dust present on the traveling surface.

The traveling surface may be a floor surface. When a carpet or the like is disposed, the traveling surface may be a top surface of the carpet.

The dust may be suctioned into a space provided by the first housing 101 through the cleaning module housing 41. The suctioned dust may be collected in the dust collector 20 and air from which the dust has been removed may be discharged to the outside of the main body 10.

The cleaning module housing 41 may be disposed to be coupled to the main body 10 to provide a space for accommodating the roller 42 to be described later therein.

Further, the cleaning module housing 41 may provide a flow path through which the air containing the dust may be suctioned such that the dust present on the traveling surface may be removed.

The cleaning module housing 41 may include a first cleaning module housing 41*a* and a second cleaning module housing 41*b*.

Specifically, the first cleaning module housing 41*a* may provide the space for accommodating the roller 42 therein as described above or a space for cleaning the traveling surface.

More specifically, the roller 42 may be received in a roller receiver 43 connected to the first cleaning module housing 41*a*. At least a portion of the roller 42 may protrude toward the traveling surface and may serve to scatter the dust settled on the traveling surface.

The second cleaning module housing 41*b* may serve to securely connect the first cleaning module housing 41*a* to the main body 10.

Specifically, an external force may be applied to the robot cleaner 100 or an unexpected shock may occur on the robot cleaner 100 during the travel.

In this connection, the first cleaning module housing 41*a* is firmly connected to the main body 10 by the second cleaning module housing 41*b*, so that a situation in which the first cleaning housing 41*a* deviates from an original position may be prevented.

In the drawing, the second cleaning module housing 41*b* is shown to be disposed at a lower side of the first housing 101, that is, a surface facing the surface to be cleaned, but is not limited thereto.

That is, there is no restriction on a connection relationship between the cleaning module housing 41 and the main body 10.

The roller 42 may serve to scatter the dust on the traveling surface while rotating.

When the roller 42 is not disposed, the cleaning may not be performed smoothly because the dust on the traveling surface is suctioned only by an operation of the dust collector 20.

Specifically, the roller 42 may separate the dust on the traveling surface from the traveling surface while rotating inside the cleaning module housing 41, and the dust separated from the traveling surface may be scattered in the air and suctioned into the main body 10 by air suction of the dust collector 20.

A roller actuator (not shown) for actuating the roller 42 may be disposed in the cleaning module housing.

The robot cleaner 100 may include the driver 30.

The driver 30 may be disposed to move the main body 10.

The driver 30 may include a main wheel 31 and a driver motor 32.

The main wheel 31 may be disposed to be rotated by receiving electric power by the driver motor 32.

Each main wheel 31 may be disposed on each of both sides of the main body 10.

The main wheel 31 disposed on one side and the main wheel 31 disposed on the other side may be controlled by different driver motors 32, respectively. That is, the main wheel 31*a* disposed on one side and the main wheel 31*b* disposed on the other side may be rotated at different rotational speeds.

Thus, the robot cleaner 100 may turn in a left or right direction. Further, the robot cleaner 100 may switch directions in combination with going straight or going backward.

That is, a travel speed of the robot cleaner 100 may be determined based on the rotational speed of the main wheel 31 and a travel direction may be determined by a difference in rotational speed of the main wheels 31.

For example, when the main wheel 31 on the left remains stationary and the main wheel 31 on the right is rotated, the robot cleaner 100 may turn to the left.

When the main wheels 31 on the both sides are operating, but when the main wheel 31 on the right rotates faster than the main wheel 31 on the left, the robot cleaner 100 may switch the direction to the left and continue moving straight.

The driver 30 may include an auxiliary wheel. A first auxiliary wheel 33 may be disposed at or adjacent to a center of the robot cleaner 100.

The first auxiliary wheel 33 is positioned adjacent to the center of the robot cleaner 100, thereby supporting a load of the robot cleaner 100 at the center of the robot cleaner 100 and simultaneously assisting the travel.

Specifically, the first auxiliary wheel 33 may be connected to a first auxiliary wheel housing 331 formed on the main body 10.

Thus, even when the first auxiliary wheel 33 is smaller than the main wheel 31, the first auxiliary wheel housing 331 may support the main body 10.

Further, the first auxiliary wheel housing 331 may be pivotable. Thus, even when the travel direction of the robot cleaner 100 is switched by the main wheel 31, the first auxiliary wheel 33 may assist the travel of the robot cleaner 100.

That is, the first auxiliary wheel housing 331 is disposed to be pivotable, so that the first auxiliary wheel housing 331 may not interfere with the travel even when the travel direction of the robot cleaner is switched.

Because the first auxiliary wheel 33 and the first auxiliary wheel housing 331 are arranged, shaking of the robot cleaner during the travel of the robot cleaner may be minimized.

The first auxiliary wheel 33 may be disposed to rotate as the travel direction of the robot cleaner 100 is switched.

Thus, the travel may be guided stably even when the robot cleaner 100 switches the direction while cleaning an area to be cleaned.

That is, the first auxiliary wheel 33 may assist the rotation of the main wheel 31 while supporting the robot cleaner 100.

A second auxiliary wheel 34 may be disposed in the cleaning module housing 41. The cleaning module housing 41 is coupled to the main body 10 to perform the cleaning. The cleaning module housing 41 may be supported by the main body 10 while being coupled to the main body 10. In another example, a portion of the cleaning module housing 41 in contact with the traveling surface (or a surface to be cleaned) may receive a supporting force by the traveling surface.

However, because the robot cleaner 100 performs the cleaning while essentially moving in a region to be cleaned, the cleaning module housing 41 may not move smoothly during the travel.

As the second auxiliary wheel 34 is disposed, the cleaning module housing 41 may be moved more smoothly during the travel of the robot cleaner 100.

Each second auxiliary wheel 34 may be disposed on each of both sides of the cleaning module housing 41 to perform a function of assisting balancing of the robot cleaner 100.

The dust collector 20 may be a portion where the dust is collected. The dust collector 20 may include a cyclone (not shown). The dust collector 20 may be in communication with the cleaning module 40.

The air may be introduced into the robot cleaner by the dust collector 20. When the air is suctioned by the dust collector 20 and the air from which the dust has been removed is discharged to the outside, a negative pressure is generated in the robot cleaner 100, so that the air containing the dust may be introduced through the cleaning module housing 41.

The dust collector 20 may be formed in a form in which relatively large dust is primarily separated and then relatively small dust is secondarily separated. However, the dust collector 20 is not limited thereto and is sufficient when being able to suct the dust present on the traveling surface.

The dust collector 20 may be disposed to be detachable from the main body 10. Thus, when the robot cleaner completes the cleaning or when excessive dust is accumulated in the dust collector 20, the user may easily separate the dust collector 20 to remove the dust, thereby ensuring convenience.

The sensor unit 11 may be disposed on the main body 10. The sensor unit 11 may provide image information such that the robot cleaner 100 may travel in the region to be cleaned.

That is, the sensor unit 11 may be a camera or a photographing sensor.

Specifically, the sensor unit 11 may collect information necessary for autonomous travel of the robot cleaner 100.

For example, the sensor unit 11 may include the photographing sensor that creates a travel map by photographing a periphery of the robot cleaner 100, an obstacle sensor that senses an obstacle, and the like. In another example, additional sensors may be further provided in addition to the above-described sensor.

For example, the sensor unit may include a wall sensor (not shown). Thus, information about the region to be cleaned may be input to the robot cleaner 100 through the wall sensor, the photographing sensor, and the like.

The robot cleaner 100 may input a shape of a space while traveling, and divide the region to be cleaned through the wall sensor into a plurality of cleaning areas.

However, the present disclosure is not limited to the above-described example, and the above-described example is only one embodiment. The photographing sensor and the obstacle sensor may simultaneously perform wall sensing.

The photographing sensor may be disposed not only to sense the region to be cleaned, but also to specify a position of the main body 10 in the region to be cleaned that is previously input. Thus, a position of the space where the robot cleaner 100 performs the cleaning may be specified and the position of the robot cleaner 100 is specified, so that movement to a next cleaning area may be guided.

A type and the number of sensor units 11 are not limited. That is, a plurality of photographing sensors may be arranged, and when the plurality of photographing sensors are arranged, the plurality of photographing sensors may be photographing sensors of the same type or different types.

The robot cleaner 100 may vary a suction strength of the dust collector 20 based on a material of the floor. This is because when the dust collector 20 always suctions the dust at the same strength, it may be difficult to completely perform the cleaning on an unusual floor surface such as the carpet and the like.

The robot cleaner 100 may include a floor sensor (not shown) to sense the material of the floor. The floor sensor may be a sensor that senses the material of the floor. The floor sensor may be disposed in the sensor unit 11 described above, or may be disposed at a position different from the sensor unit 11.

The region to be cleaned in which the robot cleaner 100 is used may vary depending on a case. For example, a floor material of the region to be cleaned may be marble or a floor paper. Further, the region to be cleaned may be made of a material other than the above example.

Depending on the material of the floor, an intensity at which the dust collector 20 is driven to effectively suction the dust may vary.

Specifically, the dust collector 20 must be driven more strongly in a carpeted region than on a general floor paper to effectively perform cleaning. The controller of the robot cleaner 100 may adjust the driving intensity of the dust collector 20 based on the type of floor material.

The obstacle sensor may determine whether an obstacle exists in the region to be cleaned. The obstacle sensor may be disposed integrally with the sensor unit 11 described above, or may be disposed separately. That is, the photographing sensor may also serve as the obstacle sensor.

As the obstacle sensor senses the obstacle, a travel path of the robot cleaner 100 may be changed. As a moving line becomes complicated, battery consumption may vary. Specifically, when the obstacle is present, the robot cleaner 100 is moved to bypass the obstacle. At this time, the moving line may be lengthened. As the moving line lengthens, a battery consumption for cleaning the corresponding area may increase.

Figure 4A:
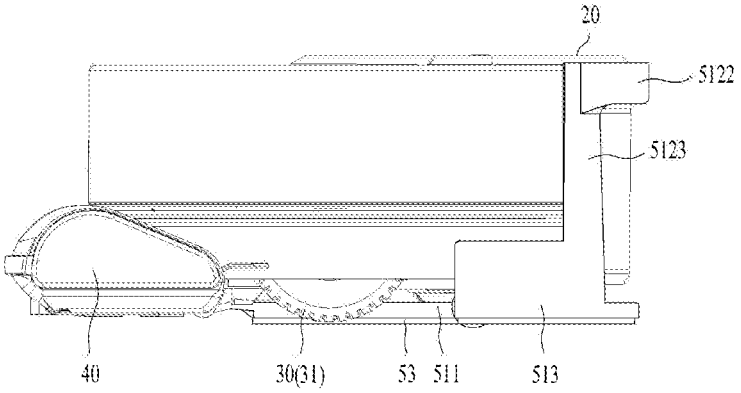
FIGS. 4A and 4B are views showing a robot cleaner according to an embodiment.
Figure 4B:
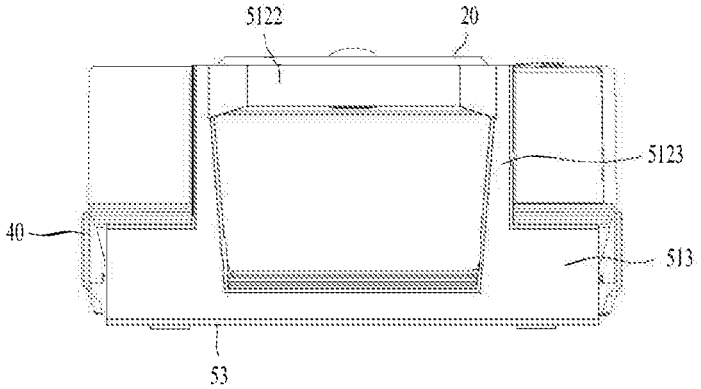

FIGS. 4A and 4B are views showing a robot cleaner according to an embodiment.

A wet-mop module of a robot cleaner according to an embodiment will be described with reference to FIGS. 4A and 4B.

The robot cleaner according to an embodiment of the present disclosure may include a wet-mop module 50.

The wet-mop module 50 may be disposed to be coupled to the main body 10. Specifically, the wet-mop module 50 may be disposed to surround at least a portion of the main body 10. The surrounding of the at least a portion of the main body 10 means that the wet-mop module 50 is disposed to surround a portion of at least one of an outer circumferential surface of the main body 10 and lower and upper surfaces of the main body 10.

The wet-mop module 50 is not disposed to cover an entirety of a surface coupled with the main body 10, and may have an opening defined therein as shown in the drawing.

For example, the exterior of the robot cleaner 100 may be determined by the main body 10 and the dust collector 20.

As shown in the drawing, when the dust collector 20 is disposed in a form protruding outward of the main body 10, the wet-mop module 50 may include a dust-collector connector 5121 in an opened form to provide a space for accommodating the dust collector 20 therein.

In another example, the wet-mop module 50 may not include an open face such as the dust-collector connector 5121 as shown in the drawing. However, in this case, a spacing may occur between the wet-mop module 50 and the main body 10. When the spacing occurs, a user's preference may be lower than when there is no spacing because of hygiene or aesthetic reasons.

Thus, the wet-mop module 50 may be formed in a shape corresponding to a shape of the main body 10.

In the drawing, the wet-mop module 50 is illustrated as being mounted at the rear portion of the robot cleaner 100, but is not limited thereto. That is, the wet-mop module 50 is sufficient when mounted on the main body 10 and does not have to be mounted in a specific direction.

However, as will be described later, the wet-mop module 50 includes a mop 53 for mopping the traveling surface. Thus, it is preferable that the mop 53 is formed in a shape of being toward the ground. Further, the wet-mop module 50 is preferably disposed such that the mop 53 may be positioned on the traveling surface when the wet-mop module 50 is coupled to the main body 10.

Figure 5:
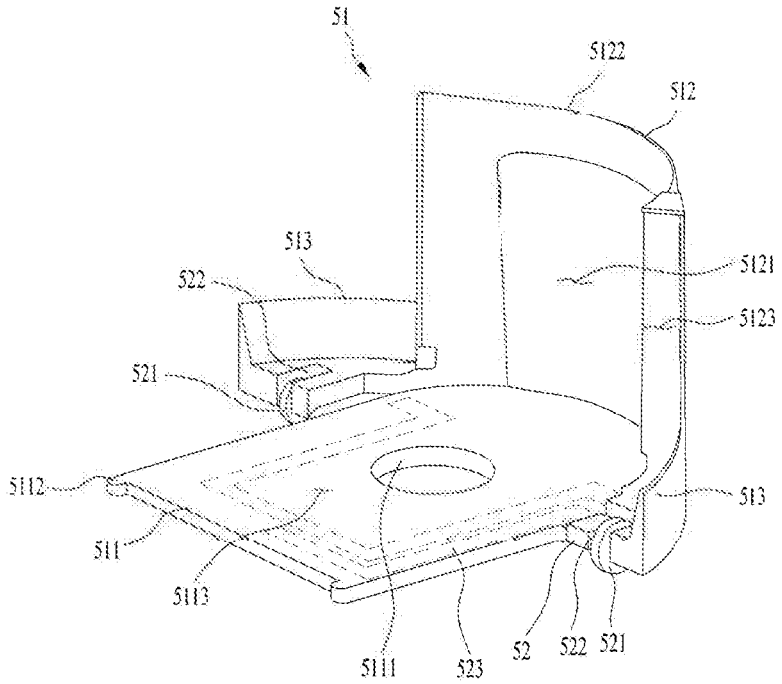
FIG. 5 is a view showing a wet-mop module according to an embodiment.
Figure 6:
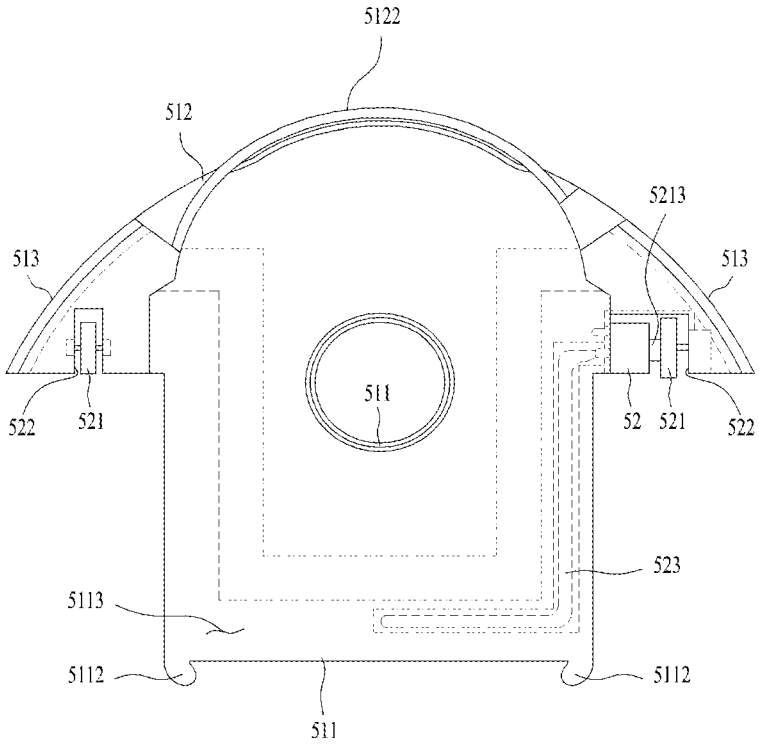
FIG. 6 is a plan perspective view of a wet-mop module according to an embodiment.
Figure 7:
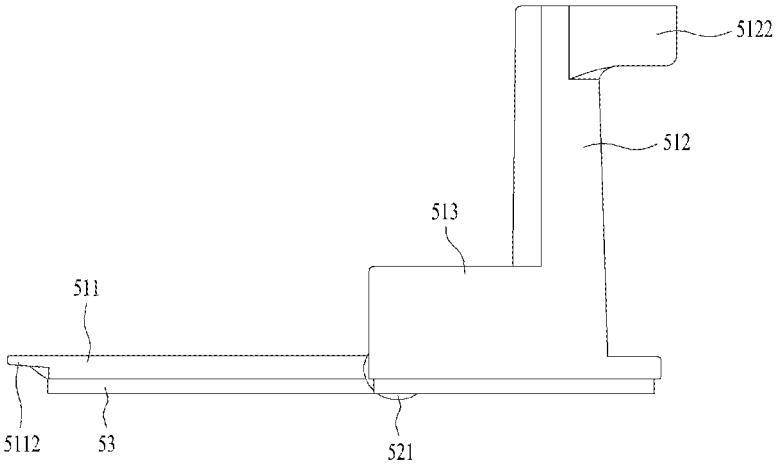
FIG. 7 is a side view of a wet-mop module according to an embodiment.

FIG. 5 is a view showing a wet-mop module according to an embodiment. Further, FIG. 6 is a plan perspective view of a wet-mop module according to an embodiment. Further, FIG. 7 is a side view of a wet-mop module according to an embodiment.

The wet-mop module 50 will be described in detail with reference to FIGS. 5 to 7.

The wet-mop module 50 may include a wet-mop module housing 51. The wet-mop module housing 51 may be a portion forming an exterior of the wet-mop module 50.

The wet-mop module housing 51 may include a first module portion 511, a second module portion 512, and a third module portion 513.

The first module portion 511 may be positioned between the main body 10 and the traveling surface. The first module portion 511 may include therein a first water storage 5113, which is a space for accommodating water therein. Because the water is accommodated in the first water storage 5113, the wet-mop module 50 may mop without a separate water tank.

A shape of the first water storage 5113 may be determined depending on a shape of the first module portion 511. Because the first water storage 5113 is an internal space of the first module portion 511, the shape of the first water storage 5113 may be determined based on the shape of the first module portion 511. Further, an amount of water accommodated in the first water storage 5113 may also be determined depending on the shape and a size of the first module portion 511.

The first module portion 511 may be disposed to cover at least a portion of a surface of the main body 10 facing the traveling surface. The mop 53 may be coupled to the first module portion 511. The mop 53 may be made of a material that may mop the traveling surface.

There is no restriction on how the mop 53 is detached from the first module portion 511.

The first module portion 511 may be positioned between the main body 10 and the mop 53 to position the mop 53 at a position at which the mop 53 is capable of mopping the traveling surface, and to couple the wet-mop module 50 to the main body 10.

The first module portion 511 may include a main body connector 5112. The main body connector 5112 may be disposed at an end of the first module portion 511 as a portion that couples the wet-mop module 50 to the main body. The main body connector 5112 of the first module portion 511 may be connected to a module coupling portion 1011 formed on the main body 10 to provide a supporting force to the wet-mop module 50.

Specifically, the main body connector 5112 may be formed in a protruding shape as a portion of the first module portion 511. The module coupling portion 1011 may protrude from the surface of the main body 10 facing the traveling surface toward the traveling surface and may extend in a direction in which the first module portion 511 is inserted. The main body connector 5112 may be inserted into a space provided by the module coupling portion 1011. The wet-mop module 50 may be supported by the main body 10 as the main body connector 5112 is coupled with the module coupling portion 1011.

The main body connector 5112 and the module coupling portion 1011 may be formed in corresponding shapes. Thus, when the wet-mop module 50 is coupled to the main body, despite the travel of the robot cleaner 100, it is possible to prevent the wet-mop module 50 from deviating from the original position thereof or shaking due to a play.

A plurality of main body connectors 5112 may be arranged. Preferably, the plurality of main body connectors 5112 are respectively arranged on both sides based on a width direction of the wet-mop module 50.

The first module portion 511 may include an auxiliary wheel connector 5111 into which the first auxiliary wheel housing 331 may be inserted. The auxiliary wheel connector 5111 may be formed in an open shape in the first module portion 511. The auxiliary wheel connector 5111 may be formed in a shape corresponding to a shape of the first auxiliary wheel housing 331.

As a result, even when the wet-mop module 50 is mounted on the main body 10, the first auxiliary wheel 33 may be seated on the traveling surface, thereby performing an original function thereof.

The second module portion 512 may be integrally formed with the first module portion 511. The second module portion 512 may also be disposed to cover at least a portion of the main body 10 of the robot cleaner 10W.

The second module portion 512 may include a handle 5122 that provides a space for the user to grip, and a second water storage 5123 that provides a space for accommodating water therein.

The second module portion 512 is disposed to have a predetermined angle with the first module portion 511, so that the second module portion 512 may be formed in a shape corresponding to at least a portion of the shape of the main body 10.

The handle 5122 may be disposed to have predetermined length and width to be gripped by the user. In the drawing, the handle 5122 and the second water storage 5123 are illustrated separately, but are not limited thereto.

That is, the handle 5122 may be disposed to provide a space for accommodating water therein like the second water storage 5123, as well as to be gripped by the user. It may be appropriately selected by the user or a designer.

The second water storage 5123 may provide an additional water storage space in case the first water storage 5113 is difficult to accommodate an adequate amount of water for the cleaning.

The second water storage 5123 may be in communication with the first water storage 5113. As the water stored in the first water storage 5113 is flowed to the mop 53, the water accommodated in the second water storage 5123 may be flowed to the first water storage 5113.

The second water storage 5123 may be extended in a height direction of the wet-mop module 50. A plurality of second water storages 5123 may be arranged.

Specifically, as shown in the drawing, the second water storages 5123 are respectively extended in the height direction from both sides of the first module portion 511 to form the dust-collector connector 5121 to which the dust collector 20 is connected. The handle 5122 may be disposed to connect the second water storages 5123 with each other.

Each third module portion 513 may be disposed on each of both sides of the wet-mop module 50.

That is, when the wet-mop module 50 is formed in a shape shown in the drawing, the third module portions 513 may be respectively arranged on both sides of the first module portion 511. Further, the third module portions 513 may be respectively arranged both sides of the second module portion 512.

Each third module portion 513 may include a wet-mop module wheel 521 that assists the support of the wet-mop module 50 and the travel of the robot cleaner 100 when the wet-mop module 50 is coupled to the main body 10.

Each wet-mop module wheel 521 may be disposed on each of the third module portions 513 on both sides. The third module portion 513 may include a recess 522 in which the wet-mop module wheel 521 may be accommodated.

The recess 522 may provide therein a space in which the wet-mop module wheel 521 is accommodated. Further, the recess 522 may be defined to provide a space in which, when a wet-mop pump 52 is disposed at one side, the wet-mop pump 52 is also accommodated.

The recess 522 may be defined by being depressed inwardly of the third module portion 513. Sizes of the recesses 522 respectively defined in the third module portions 513 may be different. This is because when the wet-mop pump 52 is disposed only on one side, the third module portion 513 on the other side does not necessarily need to have the recess 522 of the same size as the recess 522 on one side.

The wet-mop pump 52 may be disposed on the third module portion 513. The wet-mop pump 52 may be connected to the wet-mop module wheel 521. The wet-mop pump 52 may be disposed to supply water to the mop 53 based on a rotation of the wet-mop module wheel 521.

It is preferable that the wet-mop pump 52 capable of guiding the water to the mop 53 is disposed such that the water accommodated in the first module portion 511 and the second module portion 512 flows into the mop 53.

The second module portion 512 may be disposed in a form extending in the height direction of the wet-mop module 50, so that water may be flowed to some extent by a self-load of the water. However, the water may not be smoothly delivered when a water level in the second module portion 512 is lowered or when the traveling surface is inclined. Thus, it is preferable that the wet-mop pump is disposed.

A type of wet-mop pump 52 is not limited. However, it is desirable that the wet-mop pump 52 is a pump that may supply the water to the mop 53 based on the rotation of the wet-mop module wheel without a motor or a separate driver.

The wet-mop pump 52 may be in communication with the first water storage 5113, and may be in communication with the water supply passage 522 in communication with the mop 53. That is, the wet-mop pump 52 may guide the water accommodated in the first module portion 511 or the second module portion 512 to the mop 53 through the water supply passage 522.

The water supply passage 522 may have one side connected to the wet-mop pump 52 and the other side connected to the mop 53. The water supply passage 522 may be disposed in the first module portion 511.

In the drawing, the water supply passage 522 is illustrated of being connected to the mop 53 at one of the first module portions 511, but is not limited thereto. In order to evenly supply the water to the mop 53, the water discharged from the wet-mop pump 52 may be spread and supplied to the mop 53.

The water supply passage 522 may be disposed in a form of a nozzle or may be disposed as a space defined separately in the first module portion 511.

The water supply passage 522 may include a communication hole (not shown) defined in one surface of the first module portion 511 to guide the water toward the mop 53. The water supply passage 522 may guide the water to the mop 53 through the communication hole.

The first module portion 511, the second module portion 512, and the third module portion 513 may be integrally formed. That is, for convenience of description, the first module portion 511, the second module portion 512, and the third module portion 513 have been described by distinguishing names, but are not limited thereto.

In other words, the first module portion 511 is sufficient when positioned between the main body 10 and the traveling surface. Further, the second module portion 512 is sufficient when formed integrally with the first module portion 511 and covering at least a portion of an outer surface of the main body 10. Further, the third module portion 513 is sufficient when including the wet-mop module wheel 521 and the wet-mop pump 52.

Thus, the wet-mop module 50 may be formed in a shape different from the drawing shown in this specification.

Figure 8A:
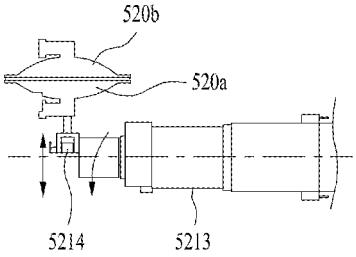
FIGS. 8A and 8B are views showing an operating principle of a pump according to an embodiment.
Figure 8B:
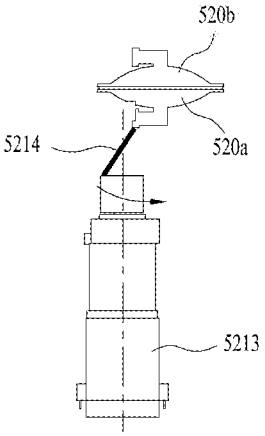

FIGS. 8A and 8B are views showing an operating principle of a pump according to an embodiment.

As described above, the type of wet-mop pump 52 is not limited. However, hereinafter, an embodiment in which the wet-mop pump 52 is disposed as a diaphragm pump will be described. The diaphragm pump is a pump that suctions and discharges fluid by a motion, which may also be referred to as a membrane pump.

A rotation shaft 5213 may be connected to the wet-mop module wheel 521. The rotation shaft 5213 may serve to fix the wet-mop module wheel 521 to the third module portion 513.

The wet-mop pump 52 may include a first diaphragm 520*a* and a second diaphragm 520*b*.

The first diaphragm 520*a* is a diaphragm connected to the rotation shaft 5213, and the second diaphragm 520*b* is a diaphragm that provides a space together with the first diaphragm 520*a* through which the water may be introduced and discharged.

The first diaphragm 520*a* may be connected to the rotation shaft 5213. Specifically, the first diaphragm 520*a* may be connected to the rotation shaft 5213 through a pump connector 5214.

As the wet-mop module wheel 521 rotates, the rotation shaft 5213 rotates, and as the rotation shaft 5213 rotates, the first diaphragm 520*a* may be curved or relaxed. When the first diaphragm 520*a* is curved or relaxed, the water accommodated in the first water storage 5113 or the second water storage 5123 may be introduced into the wet-mop pump 52 and then guided to the mop 53.

FIG. 8A is a view showing a connection relationship between the rotation shaft and the wet-mop pump according to an embodiment, and FIG. 8B is a view showing a connection relationship between the rotation shaft and the wet-mop pump according to another embodiment.

In FIG. 8A, the pump connector 5214 may be eccentric to a rotation center of the rotation shaft 5213 in the same direction as the rotation shaft 5213. Specifically, the pump connector 5214 may have a rotation center eccentric to the rotation shaft 5213. Thus, when the wet-mop module wheel 521 is rotated, the rotation shaft 5213 is rotated, and the pump connector 5214 may be rotated to revolve relative to the rotation center of the rotation shaft 5213. Accordingly, when the pump connector 5214 moves away from the first diaphragm 520*a*, the first diaphragm 520*a* moves in a direction away from the second diaphragm 520*b* and the wet-mop pump 52 generates a negative pressure, so that the water accommodated in the first module portion 511 flows into the wet-mop pump 52.

When the pump connector 5214 approaches the first diaphragm 520*a*, water accommodated between the first diaphragm 520*a* and the second diaphragm 520*b* may flow to the water supply passage 522.

That is, the pump connector 5214 may be disposed as a rotation shaft that is rotated to be eccentric to the rotation center of the rotation shaft 5213. In this case, a separate component for connecting the wet-mop pump 52 with the pump connector 5214 may be required.

Referring to FIG. 8B, the rotation shaft 5213 and the wet-mop pump 52 may be directly connected to each other. In this case, the pump connector 5214 may be disposed eccentrically to the rotation center of the rotation shaft 5213, as in FIG. 8A.

However, in this case, a position relationship between the rotation shaft 5213, the pump connector 5214, and the wet-mop pump 52 may be important.

Specifically, even when the pump connector 5214 is connected at a position eccentric to the rotation center of the rotation shaft 5213, a case in which the wet-mop pump 52 is not able to be operated normally may occur.

For example, when the pump connector 5214 is disposed such that a distance between the wet-mop pump 52 and the rotation shaft 5213 is constant despite the rotation of the rotation shaft 5213, a position of the first diaphragm 520*a* relative to the second diaphragm does not change despite the rotation of the wet-mop module wheel 521, which makes it difficult for the pump to perform the role thereof.

Thus, the pump connector 5214 is preferably disposed such that the distance between the rotation shaft 5213 and the wet-mop pump 52 changes based on the rotation of the rotation shaft 5213.

Thus, as the wet-mop module wheel 521 is rotated, the pump connector 5214 may also be rotated, and the pump connector 5214 may be rotated while revolving around the rotation center of the rotation shaft 5213. As the pump connector 5214 is rotated, the distance between the wet-mop pump 52 and the rotation shaft 5213 may change.

Specifically, when a distance between the first diaphragm 520*a* and the rotation shaft 5213 becomes smaller, the first diaphragm 520*a* moves in the direction away from the second diaphragm 520*b*, so that the water flows into the wet-mop pump 52. Further, when the distance between the first diaphragm 520*a* and the rotation shaft 5213 becomes larger, the first diaphragm 520*a* moves in a direction closer to the second diaphragm 520*b*, so that the water may be discharged to the water supply passage 522.

Figure 9A:
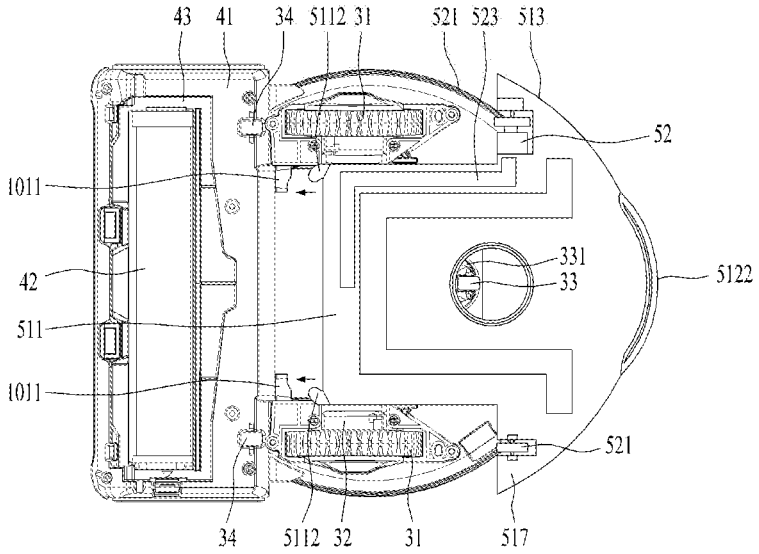
FIGS. 9A and 9B are views showing a coupling structure of a wet-mop module according to an embodiment.
Figure 9B:
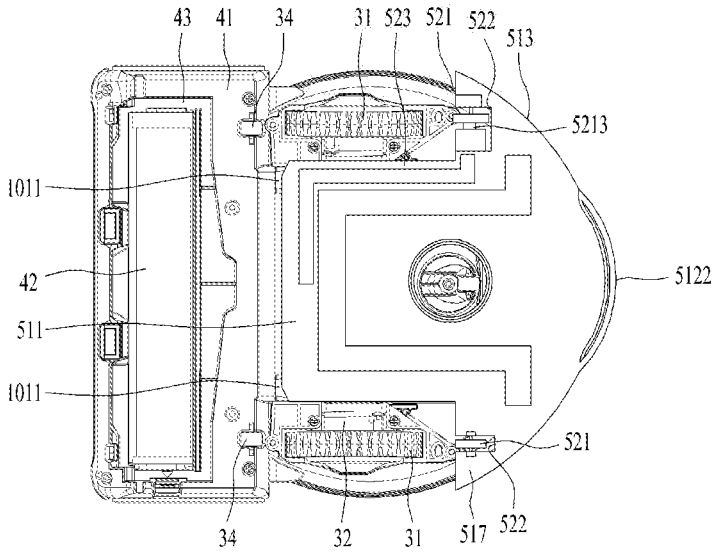

FIGS. 9A and 9B are views showing a coupling structure of a wet-mop module according to an embodiment.

As described above, the wet-mop module 50 may be combined with the main body 10.

Specifically, the wet-mop module 50 may include the main body connector 5112. It is shown in FIGS. 9A and 9B that the main body connector 5112 is disposed on the first module portion 511 but is not limited thereto.

That is, when the main body connector 5112 is disposed on the second module portion 512, it is sufficient when the main body 10 includes the module coupling portion 1011 corresponding to the main body connector 5112.

The main body connector 5112 and the module coupling portion 1011 are means for coupling the wet-mop module 50 to the main body 10. It is not important that the main body connector 5112 and the module coupling portion 1011 are respectively arranged at any specific positions of the wet-mop module 50 and the main body 10. However, it is important that the main body connector 5112 and the module coupling portion 1011 are respectively arranged at positions corresponding to each other to couple the wet-mop module 50 to the main body 10.

In a description of the embodiment shown in FIG. 9, the main body connector 5112 may be disposed on the first module portion 511. The module coupling portion 1011 may be disposed to extend in a direction in which the wet-mop module 50 is inserted to define a space in a portion of the main body 10 facing the traveling surface.

When the main body connector 5112 is inserted into the module coupling portion 1011, the wet-mop module 50 is coupled to the main body 10, so that the wet-mop module may be stably used during the travel of the robot cleaner 100.

That is, a front side of the wet-mop module 50 may be supported by the module coupling portion 1011 and a rear side of the wet-mop module 50 may be supported by the wet-mop module wheel 521.

Although the exemplary embodiments of the present disclosed embodiments have been described above in detail, those of ordinary skill in the art to which the present disclosure pertains will appreciate that various modifications are possible within the limits without departing from the scope of the present disclosure for the above-described embodiments. Therefore, the scope of the present disclosure should not be limited to the described embodiments, and should be determined not only by the claims to be described later, but also by the equivalents of the claims.

What is claimed is:

1. A robot cleaner comprising:

a main body forming an exterior of the robot cleaner;

a driver coupled to the main body and configured to move the main body;

a cleaning module coupled to the main body and configured to suck dust from a traveling surface, the cleaning module being in contact with the traveling surface;

a dust collector configured to remove dust from air suctioned through the cleaning module; and a wet-mop module coupled to the main body and configured to mop the traveling surface, the wet-mop module comprising:

a wet-mop module housing surrounding at least a portion of the main body and configured to accommodate water inside thereof;

a wet-mop module wheel disposed in the wet-mop module housing, the wet-mop module wheel being rotated in contact with the traveling surface as the main body moves;

a mop disposed between the wet-mop module housing and the traveling surface; and a wet-mop pump connected to the wet-mop module wheel to supply water to the mop based on a rotation of the wet-mop module wheel, wherein the wet-mop module housing comprises:

a first module portion positioned between the main body and the traveling surface; and a second module portion formed integrally with the first module portion and configured to cover at least a portion of an outer surface of the main body, wherein the driver comprises:

a main wheel for moving the main body;

a driver motor for providing a driving force to the main wheel;

a first auxiliary wheel for assisting the movement of the main body; and a first auxiliary wheel housing disposed on the main body and coupled to the first auxiliary wheel, and wherein the first module portion comprises an auxiliary wheel aperture penetrating the first module portion, and wherein the first auxiliary wheel housing is inserted into the auxiliary wheel aperture.

2. The robot cleaner of claim 1, further comprising:

a rotation shaft connected to the wet-mop module wheel; and a pump connector connected to the wet-mop pump, the pump connector being arranged in an eccentric configuration relative to a center of the rotation shaft.

3. The robot cleaner of claim 2, wherein the wet-mop pump comprises:

a first diaphragm configured to be curved based on a rotation of the rotation shaft; and a second diaphragm connected to the first diaphragm.

4. The robot cleaner of claim 1, wherein the first module portion comprises a first water storage comprising a space for accommodating water.

5. The robot cleaner of claim 1, wherein the main body comprises a wet-mop module coupling portion, wherein the first module portion is configured to be coupled to the wet-mop module coupling portion, and wherein the first module portion includes a main body connector accommodated in a space provided by the wet-mop module coupling portion.

6. The robot cleaner of claim 5, wherein the first module portion is configured to be inserted along a surface of the main body facing the traveling surface, and wherein the wet-mop module coupling portion extends along a direction in which the first module portion is inserted.

7. The robot cleaner of claim 4, wherein the second module portion comprises a dust-collector connector for receiving the dust collector.

8. The robot cleaner of claim 7, wherein the dust-collector connector comprises:

a handle configured to be gripped by a user; and a plurality of second water storages disposed on either side of the handle to provide a space for accommodating water.

9. The robot cleaner of claim 1, wherein the wet-mop module housing comprises a third module portion comprising the wet-mop module wheel.

10. The robot cleaner of claim 9, wherein the wet-mop module wheel is provided as a plurality of wet-mop module wheels, and wherein the third module portion comprises a plurality of recesses for connecting to each wet-mop module wheel.

11. The robot cleaner of claim 10, wherein the wet-mop module comprises at least two wet-mop module wheels disposed on either side of the first module portion, and wherein at least one of the recesses is configured to accommodate the wet-mop pump.

12. The robot cleaner of claim 9, wherein a water supply passage for flowing water therethrough is formed in the first module portion, and wherein the water supply passage is in fluid communication with the wet-mop pump and the mop.

* * * * *